United States Patent [19]

Taguchi et al.

[11] Patent Number: 4,567,859

[45] Date of Patent: Feb. 4, 1986

[54] CYLINDER HEAD STRUCTURE FOR INTERNAL COMBUSTION ENGINES

[75] Inventors: Takefumi Taguchi; Yukio Takata; Yoshimichi Tanaka, all of Hiroshima, Japan

[73] Assignee: Mazda Motor Corporation, Hiroshima, Japan

[21] Appl. No.: 673,431

[22] Filed: Nov. 20, 1984

[30] Foreign Application Priority Data

Nov. 25, 1983 [JP] Japan ..... 58-221724

[51] Int. Cl.[4] ..... F02F 1/38

[52] U.S. Cl. ..... 123/41.82 R; 123/193 H

[58] Field of Search ..... 123/41.72, 41.74, 41.82 R, 123/41.82 A, 193 H, 193 CH

[56] References Cited

U.S. PATENT DOCUMENTS 4,291,650 9/1981 Formia et al. ..... 123/41.82 A

FOREIGN PATENT DOCUMENTS 54-142412 6/1979 Japan ..... 123/41.82 R 56-41134 4/1981 Japan .

*Primary Examiner*—William A. Cuchlinski, Jr.

*Attorney, Agent, or Firm*—Fleit, Jacobson, Cohn & Price

[57] ABSTRACT

A cylinder head structure including a top wall and a bottom wall defining a cooling water passage therebetween, the bottom wall being adapted to be attached to a cylinder block. The top wall is formed with a plurality of longitudinally spaced apart camshaft bearings. The top wall is further formed beneath the camshaft bearings with transversely extending reinforcement ribs to provide an increase in rigidity.

4 Claims, 4 Drawing Figures

CYLINDER HEAD STRUCTURE FOR INTERNAL COMBUSTION ENGINES

BACKGROUND OF THE INVENTION

The present invention relates to a cylinder head structure for internal combustion engines, and more particularly to an engine cylinder head structure having top and bottom walls with cooling water passages formed between the top and bottom walls, and cam shaft bearings formed on the top wall.

DESCRIPTION OF THE PRIOR ART

In a cylinder head for an engine having a value actuating mechanism of an overhead camshaft type, there are formed a plurality of camshaft bearings which are spaced apart from each other in the longitudinal direction of the cylinder head. In case of a cylinder head for a water-cooled engine, the cylinder head is formed between the top and bottom walls with cooling water passage. An example of such cylinder head structure is shown by the Japanese laid open utility model 56-41134. In this type of structure, the load on the camshaft is as a matter of course supported by transverse walls formed between the bearing surfaces and the cooling water passages. When this type of cylinder head structure is applied to a recent light-weight engine having decreased wall thicknesses, the cylinder head has insufficient rigidity so that deformations are formed in the cylinder head due to the tightening force of the head bolts and thermal expansion as a result of heating by virtue of combustion heat. Describing more specifically, the cylinder head is subjected to combustion heat, during operation of the engine, at the mating surface with the cylinder block, or at the bottom wall of the cylinder head, whereas the top wall is maintained at a lower temperature since it is spaced from the combustion chamber by intervening cooling water passages. Thus, there is produced a temperature gradient between the top and bottom walls causing uneven thermal expansion, which tends to produce a concave deformation in the cylinder head.

It should, however, be noted that in actual practice the cylinder head is tightly secured through head bolts to the cylinder block, with the result that the lower wall of the cylinder head is laterally expanded along the mating surface with the cylinder block and the top wall is subjected to a tensile force due to the lateral expansion of the bottom wall. Thus, there is produced a peak tensile stress in the transverse wall between the camshaft bearing surface and the cooling water passage, particularly in the narrowest part of the transverse wall. The tensile stress in the transverse wall causes, together with loads applied to the camshaft bearing during engine operation, cracks in the lower part of the bearing.

OBJECTS OF THE INVENTION

It is therefore an object of the present invention to provide an engine cylinder head structure having sufficient rigidity.

A further object of the present invention is to provide an engine cylinder head structure in which cracks in the vinicity of the camshaft bearings can be effectively prevented.

SUMMARY OF THE INVENTION

According to the present invention, the above and other objects can be accomplished by an engine cylinder head structure including a top wall formed with a plurality of camshaft bearings, a bottom wall adapted to be attached to a cylinder block, cooling water passage means formed between the top and bottom walls, and a transversely extending reinforcement rib formed in the top wall to project into said cooling water passage means beneath each of said camshaft bearings. According to the features of the present invention, the reinforcement rib provides increased rigidity of the cylinder head and can suppress deformation in the cylinder head. It is therefore possible to prevent cracks which may otherwise be produced in the areas beneath the camshaft bearings.

DESCRIPTION OF THE PREFERRED EMBODIMENT

Figure 2:
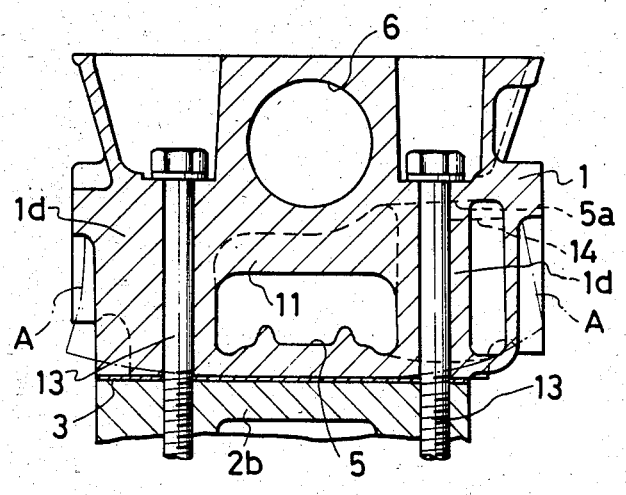
FIG. 2 is a sectional view taken along the line II—II in FIG. 1.

Referring to the drawings, there is shown a cylinder head 1 which is secured through head bolts 13 to a cylinder block 2 with an intervening gasket 3. The cylinder block 2 is formed with a plurality of cylinder bores 2*a* separated by separating walls 2*b*, and the cylinder head 1 is formed at the lower surface with cavities 1*a* confronting to the cylinder bores 2*a* to define combustion chambers 4. The cylinder head 1 has a top wall 1*b*, a bottom wall 1*c* and side walls 1*d* which define therebetween a cooling water passage 5 extending longitudinally of the cylinder head 1. On the top wall 1*b* of the cylinder head 1, there are formed a plurality of camshaft bearings 6 which are longitudinally spaced apart from each other. The head bolts 13 are located at the opposite ends of the separating walls 2*b* as shown in FIG. 2. Although not shown, the head bolts 13 are also located in the end walls 2*c* of the cylinder block 2.

Figure 4:
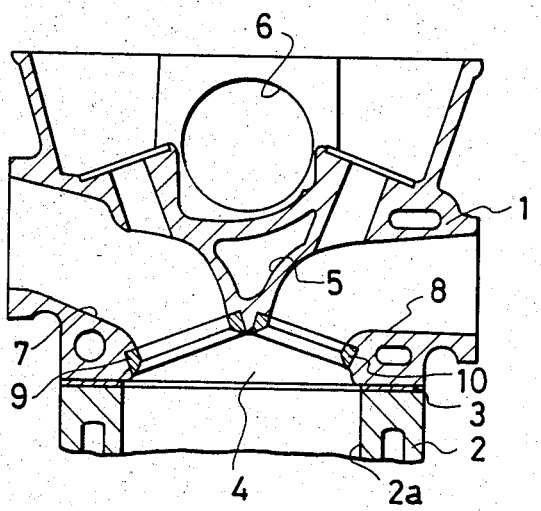
FIG. 4 is a sectional view taken along the line IV—IV in FIG. 1.

As shown in FIG. 4, the cylinder head 1 is formed with an intake port 7 and an exhaust port 8 which open to each combustion chamber 4. In the ports 7 and 8, there are respectively embedded value seats 9 and 10.

Figure 1:
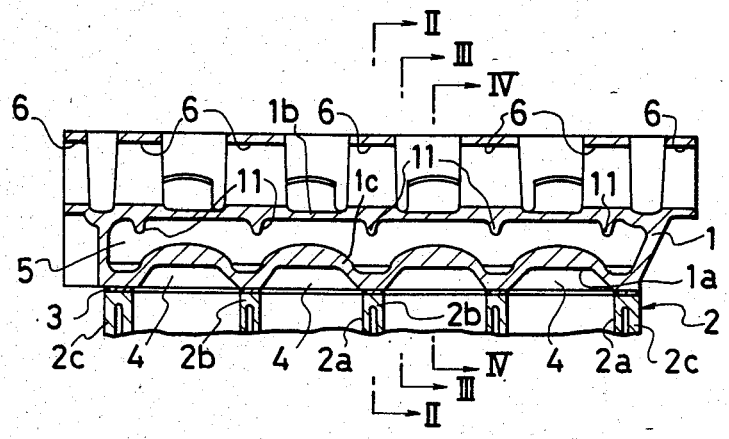
FIG. 1 is a longitudinal sectional view of a cylinder head embodying the features of the present invention, the cylinder head being shown with a cylinder block attached thereto.

Referring to FIG. 1, it will be noted that the cooling water passage 5 is formed substantially throughout the length of the cylinder head and the top wall 1*b* is formed beneath each of the camshaft bearings 6 with a transversely extending reinforcement rib 11 projecting into the cooling water passage 5. As shown in FIG. 2, the reinforcement rib 11 extends transversely between and interconnects the side walls 1*d* and functions to provide increased rigidity. The cylinder head 1 has a tendency to be deformed as shown by phantom lines A in FIG. 2 due to a difference in thermal expansion. However, since the cylinder head 1 is constrained by the head bolts 13, it is sidewardly expanded along the mating surface with the cylinder block 2 so that a tensile force is applied to the material in the top wall 1*b*. In the illustrated structure, however, the ribs 11 provide sufficient rigidity against such tensile force. Thus, the ribs 11 are effective to suppress any possible deformation of the cylinder head which may be produced by thermal expansion and the tightening force applied thereto from the head bolt 13. In the illustrated embodiment, the camshaft bearings 6 are formed at portions above the walls between adjacent cylinder bores 2*a* and the head bolts 13 are located at the opposite sides of each camshaft bearing 6.

Figure 3:
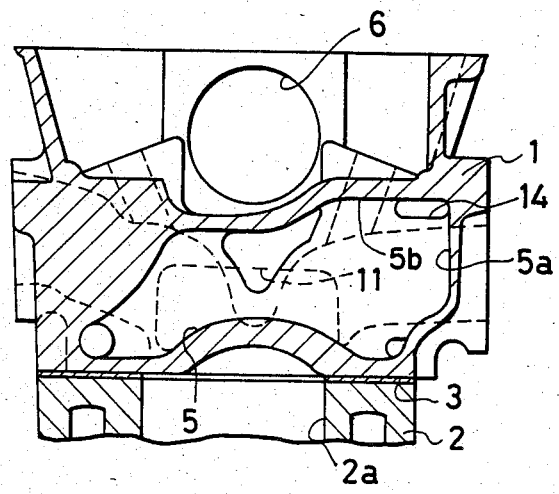
FIG. 3 is a sectional view taken along the line III—III in FIG. 1.

Between longitudinally adjacent head bolts 13, the cooling water passage 5 is sidewardly expanded to form an expanded portion 5*a*, as shown in FIGS. 2 and 3, and the expanded portion 5*a* has an upper edge 5*b* higher than the rib 11 relative to bottom wall 1*c*. A cooling water outlet 14 is formed in the cylinder head to open to the upper portion of the expanded portion 5*a*. With this arrangement, it is possible to prevent air from being trapped in the cooling water passage 5 between the reinforcement ribs 11.

The inventon has thus been shown and described with reference to a specific embodiment, however, it should be noted that the invention is in no way limited to the details of the illustrated structures but changes and modifications may be made without departing from the scope of the invention as set forth in the appended claims.

We claim:

1. An engine cylinder head structure including a top wall formed with a plurality of camshaft bearings, a bottom wall adapted to be attached to a cylinder block, side walls connecting said top and bottom walls together, cooling water passage means defined by the top, bottom and side walls, a transversely extending reinforcement rib formed in the top wall to project into said cooling water passage means beneath each of said camshaft bearings and to extend between and interconnect said side walls.

2. An engine cylinder head structure in accordance with claim 1 in which said cooling water passage means includes a sidewardly expanded portion between each two adjacent reinforcement ribs, said sidewardly expanded portion having an upper edge higher than a lower edge of the reinforcement rib, and cooling water outlet means provided in an upper portion of said expanded portion.

3. An engine including a cylinder block having at least two cylinder bores separated by at least one separating wall, a cylinder head secured to the cylinder block by head bolts, at least two of said head bolts being located adjacent to the opposite ends of the separating wall, said cylinder head including a top wall formed with a plurality of camshaft bearings, a bottom wall attached to the cylinder block and cooling water passage means formed between the top and the bottom walls, at least one of the camshaft bearings being located above said separating wall in the cylinder block, and a transversely extending reinforcement rib formed in the top wall beneath said one camshaft bearing to protect into and extend across said cooling water passage means.

4. An engine in accordance with claim 3 in which said cooling water passage means includes at least one sidewardly expanded portion above at lest one of said cylinder bores, side sidewardly expanded portion having an upper edge higher than a lower edge of the reinforcement rib, and cooling water outlet means provided in an upper portion of said expanded portion.

* * * * *